US005690232A

United States Patent [19]

Emery

[11] Patent Number: 5,690,232

[45] Date of Patent: Nov. 25, 1997

[54] RESILIENT WRAPAROUND CUSHION PACKING

[76] Inventor: Roy William Emery, 1 Donino Court, Toronto, Ontario, Canada, M4N 2H6

[21] Appl. No.: 778,885

[22] Filed: Jan. 3, 1997

Related U.S. Application Data

[63] Continuation of Ser. No. 466,786, Jun. 6, 1995, abandoned.

[51] Int. Cl.[6] ..... B65D 81/02

[52] U.S. Cl. ..... 206/585; 206/592; 206/594

[58] Field of Search ..... 206/521, 522, 206/523, 585, 591, 592, 593, 594

[56] References Cited

U.S. PATENT DOCUMENTS

| | | | |
|---|---|---|---|
| 1,929,918 | 10/1933 | Dreyer et al. . | |
| 1,958,050 | 5/1934 | Koppelman | 206/594 |
| 2,319,966 | 5/1943 | Wood et al. | 206/594 |
| 2,742,219 | 4/1956 | Van Antwerpen . | |
| 2,961,141 | 11/1960 | Lukes . | |
| 2,984,399 | 5/1961 | Gaulke | 206/591 |
| 3,225,509 | 12/1965 | May | 206/591 |
| 3,231,454 | 1/1966 | Williams | 206/594 |
| 4,492,291 | 1/1985 | Chometon et al. | 206/591 |
| 5,306,100 | 4/1994 | Higginbotham . | |
| 5,335,770 | 8/1994 | Baker et al. . | |
| 5,368,159 | 11/1994 | Doria . | |
| 5,462,171 | 10/1995 | Moog et al. . | |

*Primary Examiner*—Paul T. Sewell
*Assistant Examiner*—Luan K. Bui
*Attorney, Agent, or Firm*—Marshall, O'Toole, Gerstein, Murray & Borun

[57] ABSTRACT

Resilient wraparound cushion packing elements which can be fitted around and between miscellaneous articles in a container, said packing elements having resilient properties capable of maintaining a continuing cushioning pressure around and about said miscellaneous articles sufficient to separate and protect them from injurious contact with each other or with the walls of said container.

6 Claims, 5 Drawing Sheets

RESILIENT WRAPAROUND CUSHION PACKING

This application is a continuation of U.S. patent application Ser. No. 08/466,786, filed on Jun. 6, 1995, abandoned.

FIELD OF THE INVENTION

This invention relates to wraparound resilient cushion packing for fragile articles such as glass and chinaware, cameras and electronic equipment.

BRIEF DESCRIPTION OF THE RELATED ART

Protective packing separators made of moulded pulp or plastics for use in packaging articles such as eggs and apples and bottles are well known and have been in common use for many years.

Protective packing elements made of plastic foams for such articles as machine tools and electronic equipment are now being replaced by relatively larger single enclosures moulded from pulp or plastics to completely surround the product or groups of products in one container wherever the marketed volumes are sufficient to justify the development of the related moulding dies and equipment to produce the required special shapes, as described in U.S. Pat. No. 5,335,770.

A new development of small crushable cushion packing elements, in one instance produced in the general shape and size of one half of a peanut shell, provides a useful cushion fill adaptable for the protective packing of miscellaneous products marketed in small volume, or in irregular combinations of miscellaneous shapes. This type of protective fill has the disadvantage of the small unit size, which does not provide a fully connected protection around the individual packaged articles, since these small units may be disturbed and dislodged from their original locations between and around the individual articles by heavy vibratory conditions in transit, wherever this occurs, and thus lose the required continuity of protective separation between and around said individual articles.

SUMMARY OF THE INVENTION

Wraparound resilient cushion packing products may be injection moulded from resilient plastics such as polyester, or vacuum moulded in the same manner as egg flats and apple trays from recycled waste papers or the like. Each of said packing products is comprised of an interconnected group of resiliently collapsible tubular elements banded together in at least one row of said elements. Each of said tubular elements is comprised of four walls, a top wall, a bottom wall, and two accordion pleated side walls. Each of said pleated side walls is comprised of at least two planar side wall segments. All of said walls and wall segments are integrally connected together at their adjacent edges at openly curved folds, thereby maintaining the same thickness and strength of materials in said folds as in the planar side wall and wall segments which they connect together. In this way the folding stresses created at said folds by the collapse or partial collapse of said side walls are extended into and shared with the adjacent areas of all of said walls and wall segments.

The level of resiliency and the number of folding events through which that level may be closely maintained are distinctly improved in cushion packing products made in this way, as compared with similar products made by creasing or tightly folding planar sheets of paper or paperboard.

In a preferred embodiment of this invention, the tubular elements of said cushion packing products are formed with a taper extending from a larger hole at one end to a smaller hole at the other end, thereby to facilitate removal of said cushion packing products from the moulding dies, and nesting said products for shipment or storage. Said tubular elements of said cushion packing products are connected together in rows at their large hole ends by a continuous band or bands, which bands are comprised in part of the extensions of either or both of said top walls and said bottom walls of said tubular elements. Said top wall and said bottom wall of each of said tubular elements may also be extended at their small hole ends, thereby forming extensions which may be overlain in use by the continuous band of an adjacent cushion packing product. With this tapered form and because the tubular elements are not interconnected at the small hole ends, the small hole ends of said tubular elements may assume a wider or narrower spacing than at the banded large hole ends, thereby to accommodate a bulge or a larger or smaller diameter at some part of the exterior of the article to be protected.

In use, a continuous ring of said tubular cushioning elements may be formed by inserting the tapered tubular element at one end of a banded row of said elements into the tapered tubular element at the other end. A stronger cushioning effect may be obtained by inserting tapered tubular elements of one row of said elements into the tapered tubular elements of another row.

BRIEF DESCRIPTION OF THE DRAWINGS

In the drawings, which illustrate a preferred embodiment of the invention.

DETAILED DESCRIPTION OF A PREFERRED EMBODIMENT

Figure 1:
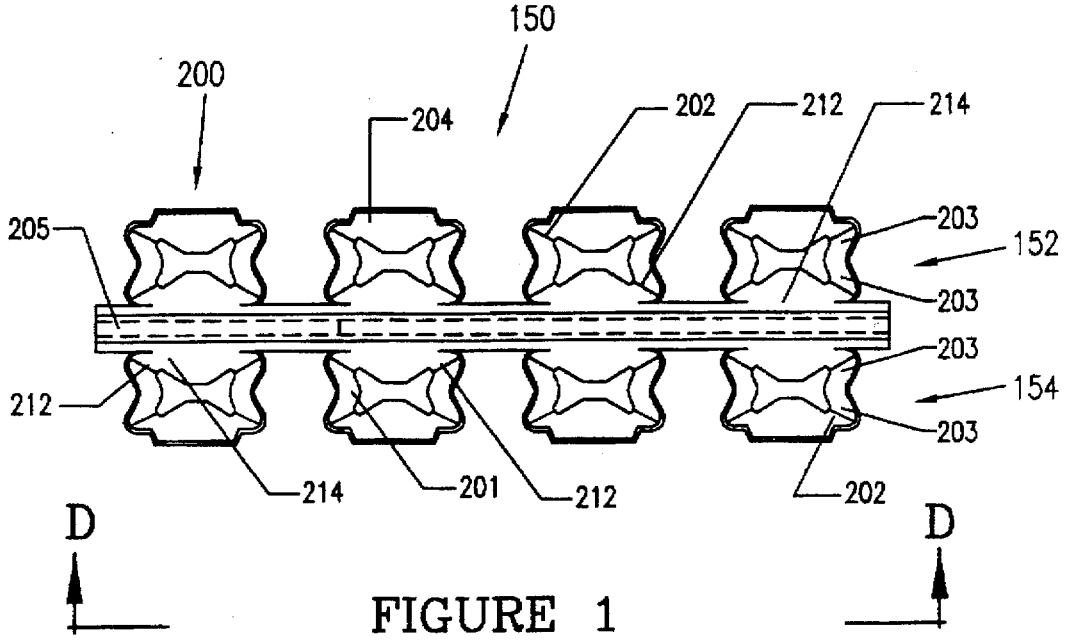
FIG. 1 is a plan view of an interconnected group of eight tapered cushioning elements of a preferred embodiment in two rows of four of said elements in each row.

In the example of a preferred embodiment shown in FIGS. 1 to 4, a group 150 of cushioning elements 200 are joined together and joined into rows 152, 154 by a connecting bridge or band 205. Each of said elements is comprised of:

a top wall 204 extended at both free ends 220, 222 beyond the side walls 203 of said element;

a bottom wall 214 extended at a narrower free end 230 and joined at its other, wider end 232 to Connecting bridge 205;

and two accordion pleated side walls, each comprised of two side wall segments 203 connected at folds 201 in pairs, said upper side wall segments 203 of each pair being connected to said top walls at folds 202, and said lower side wall segments 203 being connected to said bottom walls 214 at folds 212.

As seen in FIG. 1, the folds 201, 202, 212 are openly curved with the same thickness as the walls 203, 204, 214.

Figure 2:
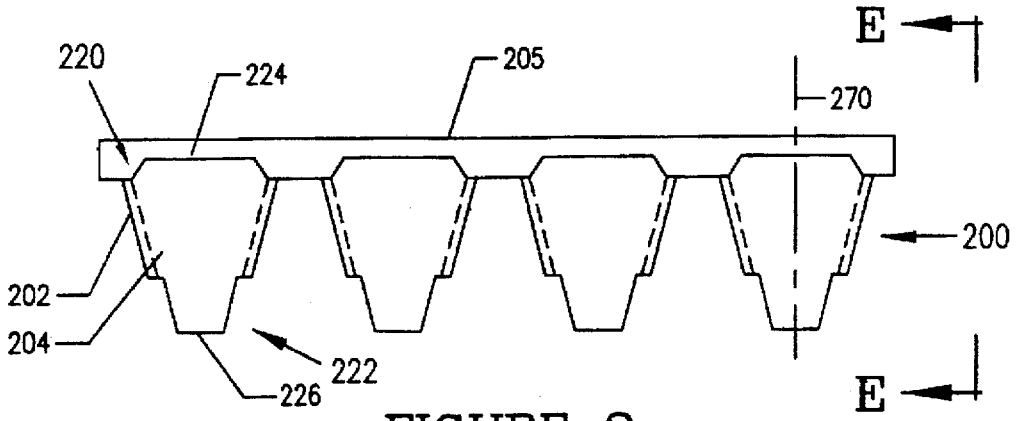
FIG. 2 is a view of one row of four of said tapered cushioned elements from line DD of FIG. 1.
Figure 4:
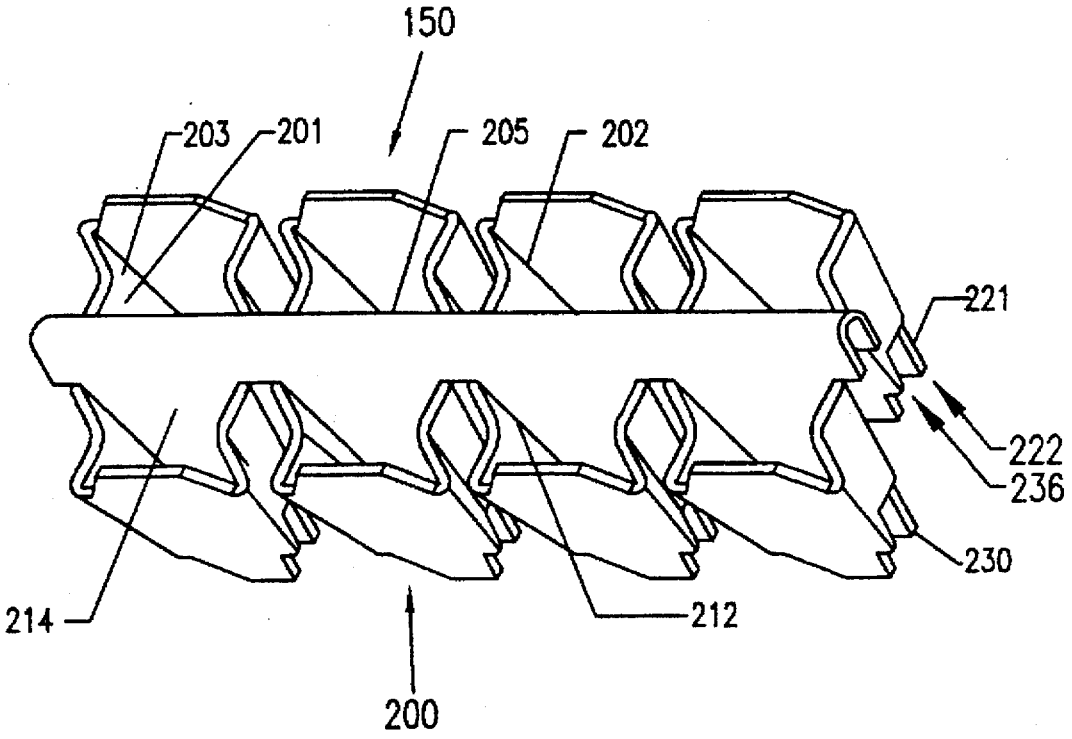
FIG. 4 is a perspective view of the eight tapered cushioning elements of FIGS. 1 to 3.

Referencing FIGS. 2 and 4, the top wall 204 of each element tapers from a wide end 220 to a narrow end 222. The bottom wall is similarly tapered from its wide end 232 to its narrow end 230. The taper of the top and bottom walls of an element 200 makes an angle of not less than ten degrees about central axis 270 of the element. FIG. 2 also shows the extensions 224, 226 of each top wall at each of its two free ends.

Figure 3:
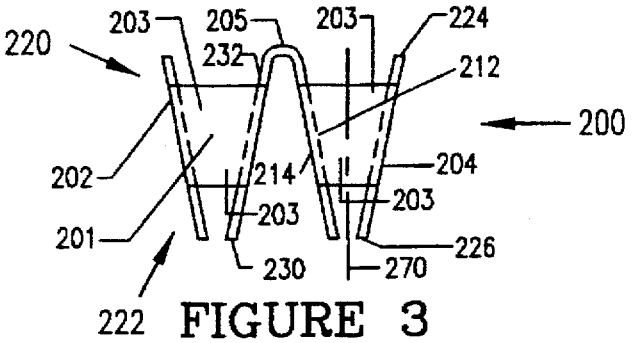
FIG. 3 is a view from line EE of FIG. 2 showing two of said tapered cushioning elements.

As seen in FIGS. 1, 3 and 4, each top wall 204 is free of connection with any other top wall. to facilitate wrapping said group around a non planar exterior of an article to be protected.

FIG. 3 is a view of said group of two rows of elements 200 at line EE of FIG. 2, showing the four tapered sidewall segments 203 connected together in pairs at folds 201, and connected to the remainder of said elements 200 at folds 202. Also shown are the extensions 224, 226 of top walls 204, and the extensions 230 of bottom walls 214.

Each side wall (comprising segments 203) of an element is tapered about central axis 270, again so as to make an angle of not less than ten degrees about central axis 270 of the element.

Referring to the perspective view of FIG. 4 along with FIGS. 1 and 3, the taper of the side walls and top and bottom walls of an element, results in a larger diameter opening 234 at end 220 of the top wall of the element and a smaller diameter opening 236 at end 222. Where the groups 150 of elements 200 are formed by moulding dies, this facilitates their removal from such dies. It also facilitates nesting of separate groups of elements for shipment or storage.

Figure 7:
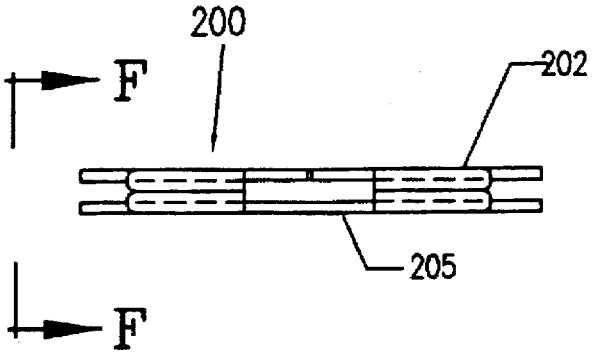
FIG. 7 is a view showing the tapered cushioning elements of FIG. 6 in a totally collapsed position.
Figure 8:
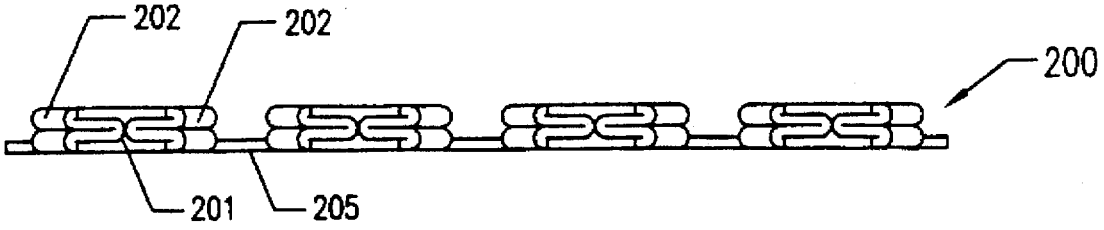
FIG. 8 is a view from line FF of FIG. 7 showing said elements in a totally collapsed position.

As seen from FIGS. 1 and 3, the width of each of the planar segments 203 of the side walls at any point between ends 220 and 222 is less than half the width of each of the top wall 204 and bottom wall at this same point. This ensure that the side walls of an element do not interfered with each other when the element is in a totally collapsed condition (as seen in FIGS. 7 and 8).

Where required, in other examples of this embodiment, said tops walls 204 may be banded to the top walls of another row of elements 200 at their extensions 224 by a continuous band similarly to bridge 205.

Figure 5:
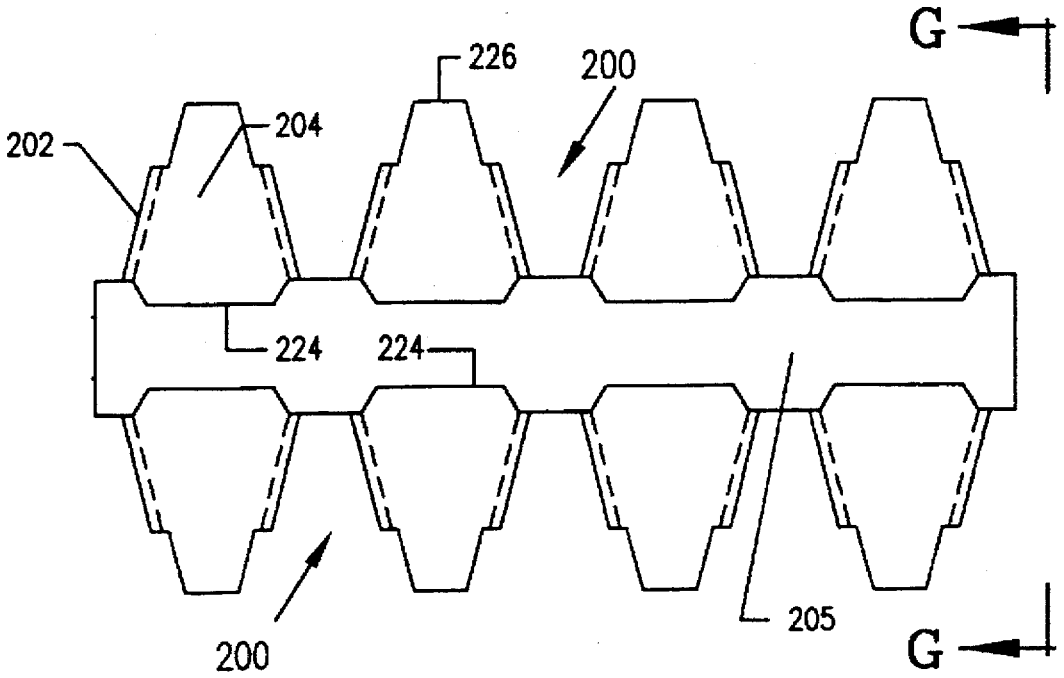
FIG. 5 is a plan view of said two rows of four of said tapered cushioning elements in each row of FIG. 1, said rows of said elements having been rotated about a central bridge into an operating position, ready to receive a pressure loading from above.

FIG. 5 is a plan view of said group of elements 200 of FIG. 1, folded out into an operating position, showing each of said top walls 204 with their narrow ends 226 extending outwardly, and connected to the remainder of each of said elements 200 at folds 202. Also shown is the bridge 205 which connects together said bottom walls.

Figure 6:
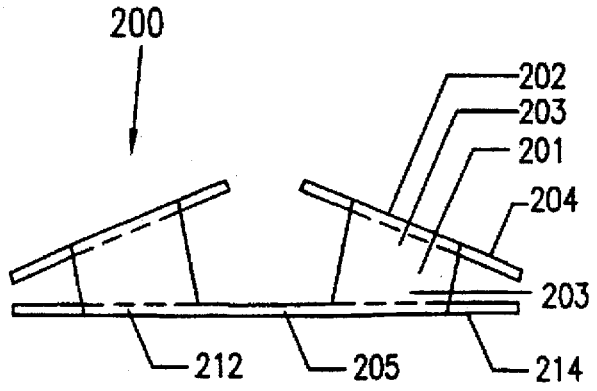
FIG. 6 is a view of said two rows of cushioning elements from line GG of FIG. 5.

FIG. 6 is a view of said two rows of cushioning elements 200 of FIG. 5 at line GG of FIG. 4, showing said elements connected together in two rows by connecting band 205, and showing for each of said elements 200, one pair of side wall segments 203 connected together at their adjacent edges by folds 201, with the outer edges of each pair connected at folds 202 and 212.

FIG. 7 is a view of the elements of FIG. 5 showing the elements 200 in a totally collapsed condition at said folds 202.

FIG. 8 is a view at line FF of FIG. 7, showing elements 200 in a totally collapsed condition, and showing the folds 201 and 202, and parts of the connecting band 205.

The rows of cushioning elements may be injection moulded from resilient flexible plastics, such as polyester, or vacuum moulded by a pulp moulding process from recycled waste papers or other fibrous moulding materials in the same manner as egg flats and apple trays. This, along with the open curve of the folds 201, 202, 212, results in integrally formed elements 200 of uniform thickness and strength, even at the folds, so that the folding stresses created at the folds by the partial or total collapse of the side walls are extended into, and shared with, the areas of the elements adjacent to the folds.

Figure 9:
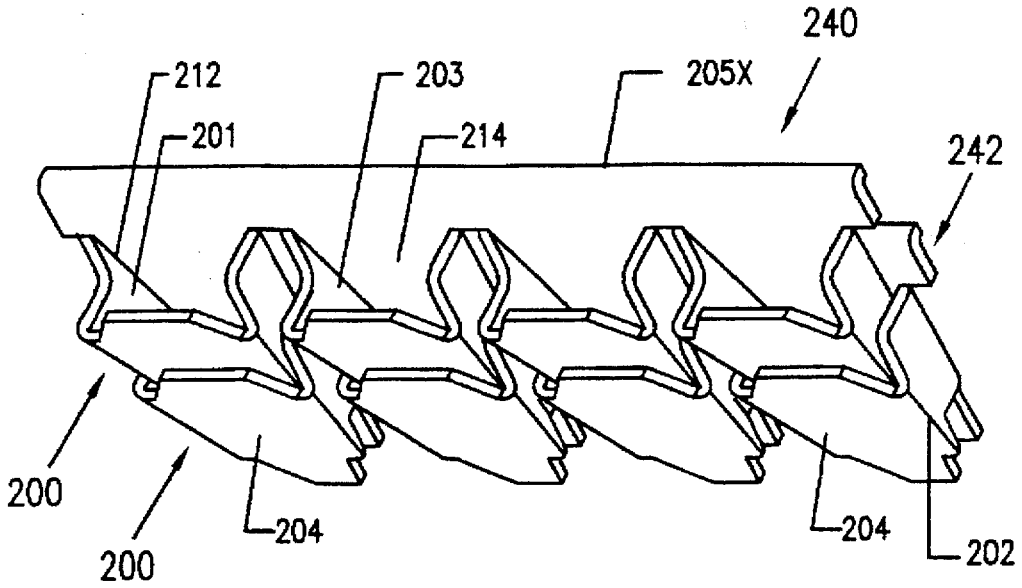
FIG. 9 is a perspective view of the elements of FIG. 4 showing the element divided into two groups, each group comprising one row of four of said elements with each one of the elements of one group inserted into a corresponding element of the other group.

FIG. 9 is a perspective view of the eight cushioning elements 200 of the group of said elements shown in FIG. 4 after said group has been divided along the centreline of connecting bridge 205 of FIG. 4 into two groups, each group comprising one row of four of said elements connected together by one half width 205X of said bridge 205 of FIG. 4, with each of the four cushioning elements of a first one of said two groups 240 loosely fitted into the corresponding one of said four elements in the second of said two group 242. The nested elements 200 of FIG. 9 provide a stronger cushioning effect.

Figure 10:
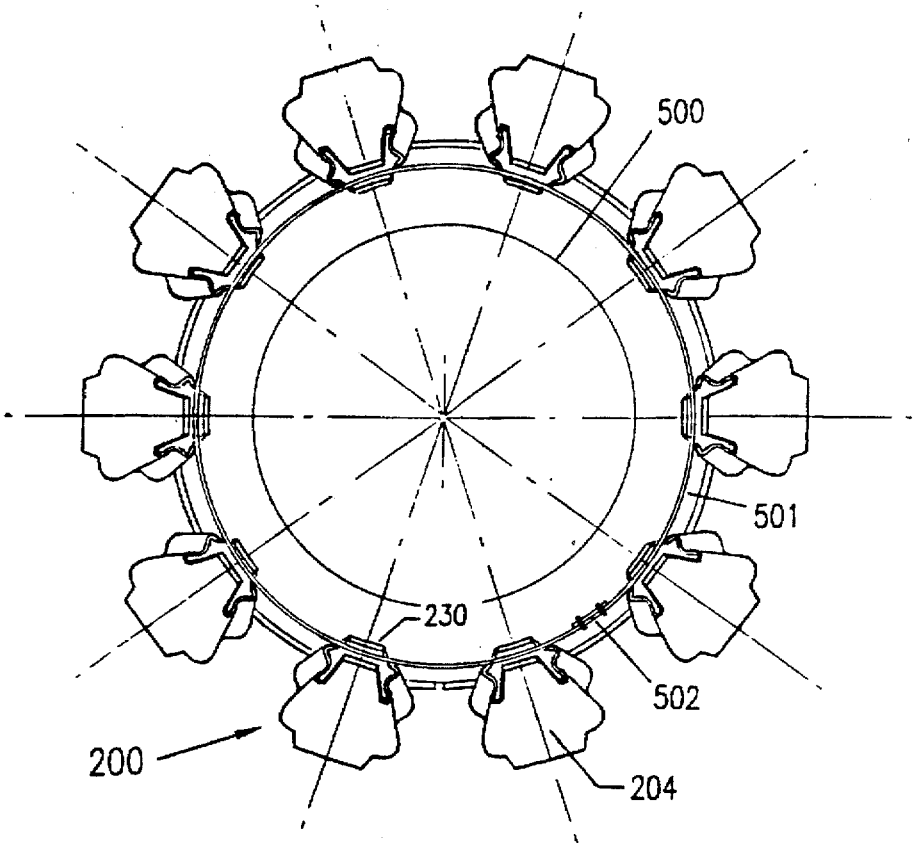
FIG. 10 is an elevation showing a group of two rows of said cushioning elements wrapped around an article having a larger dimension at mid-height.
Figure 11:
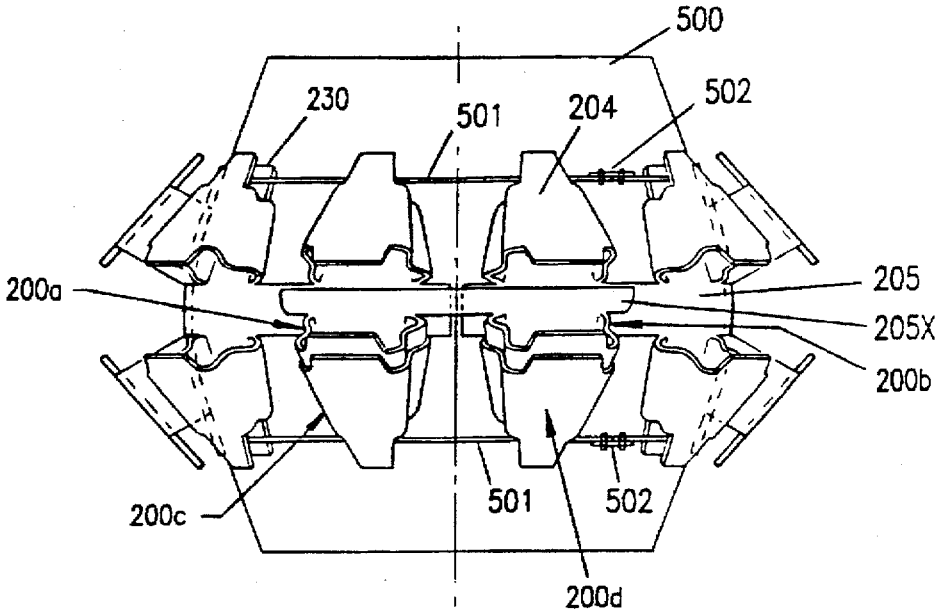
FIG. 11 is a plan view of FIG. 10 of said rows of said cushioning elements wrapped around an article with a larger diameter at mid-height.

FIGS. 10 and 11 show an article 500 with an enlarged diameter at mid-height encircled by a group 250 comprised of a plurality of said cushion packing elements 200 of FIG. 5.

FIG. 11 shows said first group 250 of cushioning wrapped around said article with the connecting band 205 of said first group 250 located around said article 500 at its largest diameter. The first group 250 is joined together at its free ends by the insertion of the two elements 200*a*, 200*b* of a second group 252, one into each of two corresponding elements 200*c*, 200*d*, at each end of said first group.

The extensions 230 of the bottom walls 214 of said first group 250, may optionally be held in place by a tape or cord 501 tightly wrapped around them and joined by clamp 502, or by the connecting band 205 of an adjacent group of said cushioning segments providing additional protection to the exterior of said article 500.

Modification will be apparent to those skilled in the art and, therefore, the invention is defined in the claims.

What I claim is:

1. A group of resiliently collapsible tubular cushion packing elements integrally formed by a moulding process and connected together in at least one row of at least two of said elements by at least one connecting band, each of said at least one connecting band being comprised in part of the extension at one end of a top wall or a bottom wall of each of said cushion packing elements, each of said elements being comprised of said top wall, said bottom wall, and two accordion pleated side walls, said top wall and said bottom wall being spaced a predetermined distance apart by the integral connection of each of said top wall and bottom wall at a fold at each of two opposite edges thereof to an adjacent edge of one or the other of said two accordion pleated side walls, each of said side walls being comprised of two planar segments of similar form and equal dimensions integrally connected in a symmetrical pair at the adjacent edges of each of said pair at a fold directed inwardly of the resilient cushion packing element, all of said folds which connect together said walls and side wall segments being openly curved folds, thereby maintaining the same thickness and strength of materials in said folds as in said walls and wall segments, whereby said element may maintain cushioning pressure between the surfaces of two articles to be separated and protected from each other, and when greatly or totally collapsed by extraordinary pressure between said surfaces, said side walls will recover when said extraordinary pressure is reduced or removed.

2. The group of interconnected resiliently collapsible tubular cushion packing elements of claim 1, each of said tubular elements having a central axis, and being tapered from a larger opening at one end of said tubular element to a smaller opening at an opposite end, each said tubular elements being comprised of said top wall, said bottom wall, four of said side wall segments, and said folds, each of said walls and wall segments being tapered from the larger end of said tubular element to the smaller end thereof at an angle with said central axis, of not less than ten degrees, thereby to provide for their convenient removal from any moulding or finishing dies, and also to provide for their convenient nesting and denesting of said groups in storage.

3. The group of resiliently collapsible tubular cushioning elements of claim 1, formed from polyester or another resiliently flexible plastic by injection moulding.

4. The group of resiliently collapsible tubular cushioning elements of claim 2, formed from recycled waste papers or other fibrous moulding materials, by a pulp moulding process.

5. The group of resiliently collapsible tubular cushion packing elements of claim 1, where each of said two planar segments of said accordion pleated side walls of said cushion packing elements is of lesser width between fold lines at opposite edges thereof than one half the width of either of said top or bottom walls between the fold lines at the opposite edges thereof, thereby ensuring that the inwardly projected edges of said planar elements of said oppositely located accordion pleated side walls do not overlap or otherwise interfere with each other when said cushion packing element is in a totally collapsed condition.

6. The group of interconnected resiliently collapsible tubular cushion packing elements of claim 1, where a narrower end of said top wall or said bottom wall of each of said elements is extended outwardly thereof, thereby to form an extension which can be overlain by the connecting band of an adjacent one of said groups.

* * * * *